US010774548B2

(12) United States Patent
Pike et al.

(10) Patent No.: US 10,774,548 B2
(45) Date of Patent: Sep. 15, 2020

(54) TROWEL FOR FINISHING CEMENTITIOUS MATERIALS

(71) Applicant: Campione Partners, LLC, Media, PA (US)

(72) Inventors: Gary J. Pike, Broomall, PA (US); Lawrence F. Shay, Media, PA (US)

(73) Assignee: Campione Partners, LLC, Media, PA (US)

( * ) Notice: Subject to any disclaimer, the term of this patent is extended or adjusted under 35 U.S.C. 154(b) by 69 days.

(21) Appl. No.: 16/072,220

(22) PCT Filed: Jan. 27, 2017

(86) PCT No.: PCT/US2017/015491

§ 371 (c)(1),
(2) Date: Jul. 24, 2018

(87) PCT Pub. No.: WO2017/132606

PCT Pub. Date: Aug. 3, 2017

(65) Prior Publication Data

US 2019/0032345 A1 Jan. 31, 2019

Related U.S. Application Data

(60) Provisional application No. 62/288,098, filed on Jan. 28, 2016.

(51) Int. Cl.
*E04F 21/24* (2006.01)
*E04F 21/16* (2006.01)

(52) U.S. Cl.
CPC ..... *E04F 21/24* (2013.01); *E04F 21/161* (2013.01)

(58) Field of Classification Search
CPC ..... E04F 21/161; E04F 21/24
See application file for complete search history.

(56) References Cited

U.S. PATENT DOCUMENTS 2,882,716 A * 4/1959 Anderson, Sr. ..... E04F 21/08 401/139
3,045,271 A 7/1962 Cinotti
(Continued)

FOREIGN PATENT DOCUMENTS

DE 202008001870 7/2009
DE 202009001870 U1 * 7/2009 ..... B05C 17/002
WO 2006087532 8/2006

OTHER PUBLICATIONS

DE 202009001870 U1—English Machine Translation (Year: 2009).*

*Primary Examiner* — Marc Carlson
(74) *Attorney, Agent, or Firm* — Joseph F. Aceto, Esq.

(57) ABSTRACT

The present invention provides a modified finishing trowel tool comprising a blade having a contact surface with a planar and convex component. One edge of the longitudinal edge of the blade is configured with a protruding convex surface such that when pushed or parallel with the trowel handle a uniform concave channel way is formed along the surface of the semi-cured cementitious surface. Thus when the trowel is oriented in a substantially horizontal position along the surface and moved along its longitudinal direction, a concave indentation is created in the cementitious material. This trowel is particularly useful in forming a uniform drainage ditch along the surface of the final, cured cementitious material such as along the perimeter of a cement basement floor.

18 Claims, 5 Drawing Sheets

(56) References Cited

U.S. PATENT DOCUMENTS

| | | | | |
|---|---|---|---|---|
| 4,674,186 | A * | 6/1987 | Galiano | B44D 3/162 15/236.07 |
| RE36,463 | E | 12/1999 | Jarvis | |
| D487,685 | S * | 3/2004 | Zeilinger | D32/46 |
| 2001/0052163 | A1 | 12/2001 | Kelsay et al. | |
| 2003/0084545 | A1 | 5/2003 | Cheng | |
| 2005/0034262 | A1 | 2/2005 | Chang | |
| 2005/0053723 | A1 | 3/2005 | Brzoska | |
| 2005/0188492 | A1 | 9/2005 | Coon | |
| 2005/0217050 | A1 | 10/2005 | Meyers | |
| 2006/0073279 | A1 | 4/2006 | Nistico | |
| 2007/0163067 | A1 | 7/2007 | Huang | |
| 2008/0006761 | A1* | 1/2008 | Vitale | B28B 7/0085 249/57 |
| 2008/0095570 | A1* | 4/2008 | Lepage | E04F 21/165 401/266 |
| 2009/0217476 | A1 | 9/2009 | Hurley | |
| 2009/0288265 | A1 | 11/2009 | Wolan | |
| 2012/0180241 | A1* | 7/2012 | Gibeau | E04F 21/161 15/235.4 |
| 2012/0324669 | A1 | 12/2012 | Couch | |
| 2013/0177354 | A1 | 7/2013 | Farrell | |
| 2013/0255016 | A1* | 10/2013 | Berney | E04F 21/163 15/105 |
| 2014/0115804 | A1* | 5/2014 | Propst | E04F 21/24 15/235.6 |
| 2015/0026907 | A1* | 1/2015 | Couch | E04F 21/241 15/245.1 |
| 2015/0143650 | A1 | 4/2015 | Davidian | |

* cited by examiner

TROWEL FOR FINISHING CEMENTITIOUS MATERIALS

CROSS-REFERENCE TO RELATED APPLICATIONS

This application is the US national application of PCT/US2017/015491, filed on 27 Jan. 2017 and which claims priority to U.S. Provisional Application No. 62/288,098, filed Jan. 28, 2016, the disclosure of which is herein incorporated by reference in its entirety.

BACKGROUND OF THE INVENTION

1. Field of the Invention

The present invention relates generally to construction tools and more specifically to a finishing trowel which is used to form concave surfaces.

2. Description of the Prior Art

Cementitious materials such as concrete, stucco, and plaster are routinely used in the construction of most buildings and various man-made structures. Stored as a powdery substance, this loosely mixed powder can be mixed with gravel or sand, but when water is introduced to the powder the mixture takes on a slurry-like composition which is then "worked" into a final form by evaporating residual water and continually smoothing the surface with tools designed to create a flat, smooth finish. When the material is sufficient dry, it cures or polymerizes into a hardened structure. There are other types of applicators available that create a more textured finish.

In many new home constructions and in some older buildings, a cement floor is incorporated into the design of the basement. This serves to create an additional room for use and to provide a means of insulating the dwelling from radon release through the ground. The basement floor is sealed by pouring a cement floor that is continuous with the walls and leveled to form a flat smooth flooring surface in contact with the walls.

Unfortunately, this type of basement floor does not restrict water or condensation formed on the walls to drain down and collect in a controlled fashion. Usually with this type of construction, the water runs down the wall and splays across the surface of the basement floor, resulting in a wet basement floor and making the basement susceptible to mold.

Conventional trowels have been used for years to shape and work the wet cementitious material in forming a flat smooth surface. These conventional trowels often have a flat, rectangular blade attached to a handle to allow the user to work the surface and form the desired finish. However, the flat blade of a conventional trowel is not effective when the surface to be worked is concave, specifically a concave tubular shape situated along the flat surface to form a channel way.

A round trowel has been described previously (US 2012/0180241). Unlike the present invention, this tool is completely convex on the contact surface for working within a concave area.

The trowel of the present invention solves the problem of creating a flat, smooth cementitious surface having a subsurface channel way molded within the curing material. Rather than having a conventional trowel form a flat smooth surface which may then be subject to being embossed with a pipe or tube, the trowel of the present invention provides a simple and efficient method of shaping and working wet cementitious material into a flat surface having a concave depression.

The previously described round trowel (US 2012/0180241) is a tool having a working surface that is completely convex and used for working within a concave area. The round trowel does not have a blade with both a flat and convex component on the contact portion of the blade, thereby ensuring the formation of a concave channel way along the level surface. The advantage of having a blade with this type of design is to ensure a uniform concave shape along a smooth level surface after working the wet material prior to curing.

SUMMARY OF THE INVENTION

The trowel of the present invention is similar to a conventional finishing trowel in that it has a blade with a working surface and an attached handle. However, the surface of the blade in contact with the cementitious material is not completely planar, but contains a portion having an outward curve, most preferably a convex or tubular shape along the longitudinal edge of the contact surface such that when used on the working surface creates an incurvate on the finished surface resulting, for example, in a channel way running along the direction of the trowel movement. Thus, the preferred embodiment incorporates a cementitious contact surface comprising a blade having a flat planar portion with a convex tubular portion juxtaposed along a longitudinal edge of the blade. The blade allows the user to easily form an even channel way while working the cementitious material.

DETAILED DESCRIPTION

Figure 1:
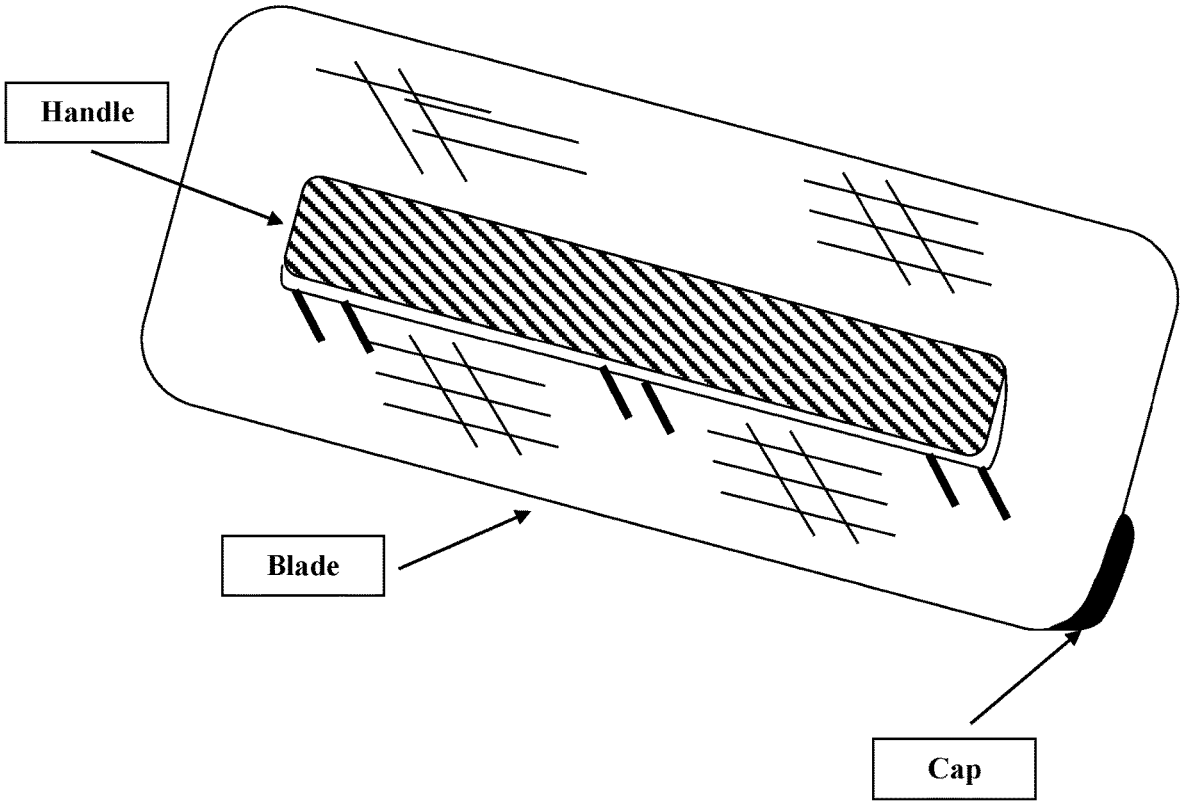
FIG. 1 is a perspective view showing the trowel with its handle and upper surface of the blade.
Figure 2:
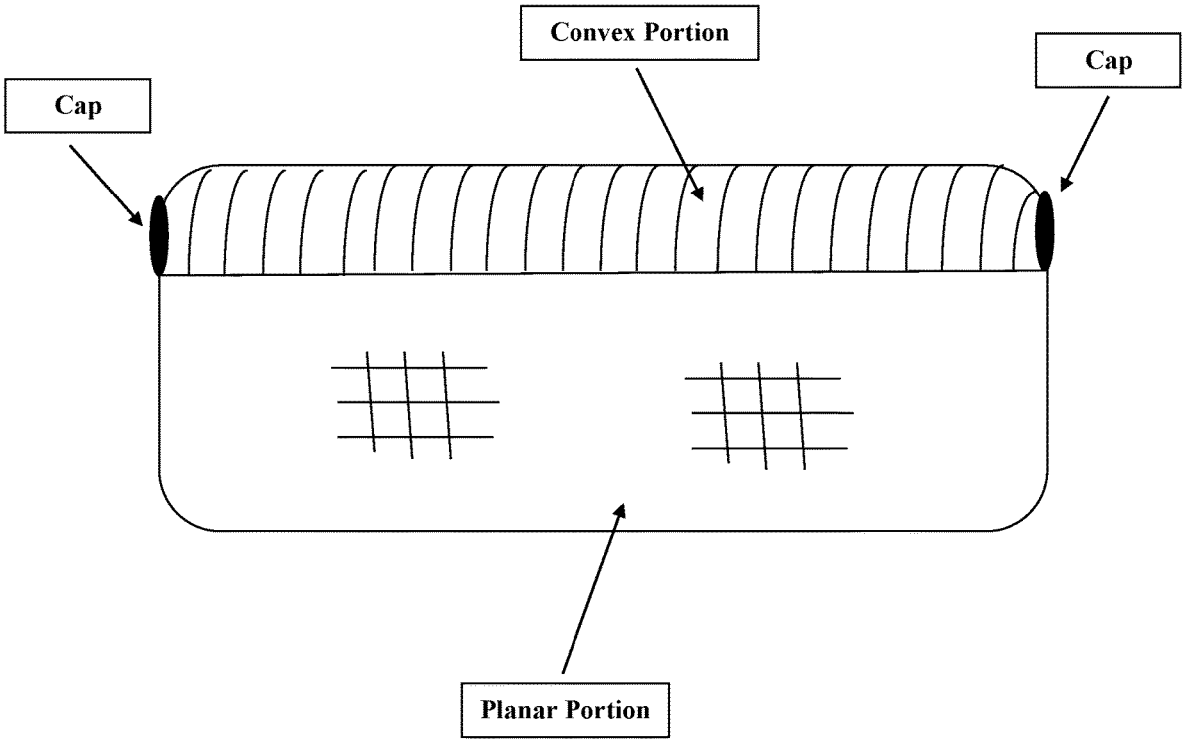
FIG. 2 is a bottom view of the blade showing the contact surface with the planar and convex components.
Figure 3:
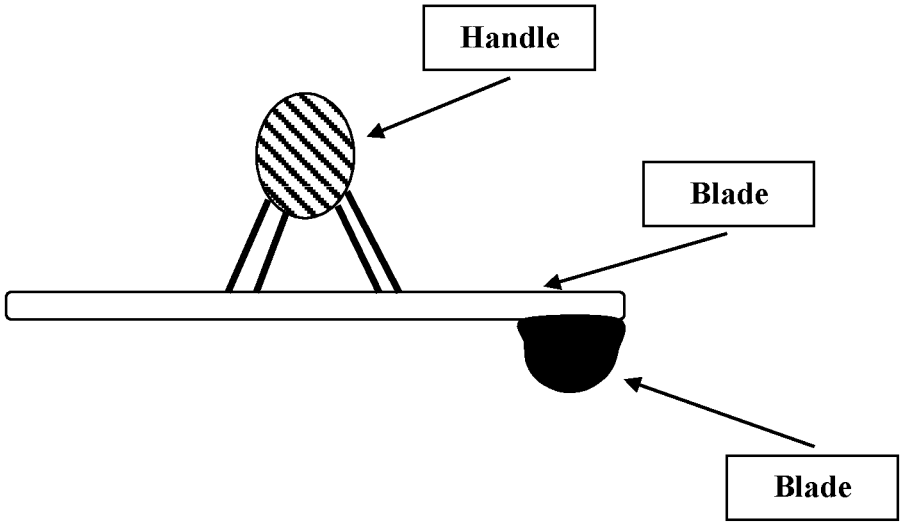
FIG. 3 is a front view of the trowel showing the front edge of the planar surface and the rounded cap on the convex surface.

Referring to the drawings, FIGS. 1, 2, and 3, there are shown various views of the trowel claimed in the present invention. FIG. 1, FIG. 2, and FIG. 3 show views of the towel itself and FIG. 4 depicts an exemplary surface after working with the trowel of the present invention.

FIG. 1 is a view of the upper side of the trowel. The handle (striped area) is attached to the noncontact surface of the blade (white area). The cap for the convex portion of contact surface of the blade is shown, providing ease of use (solid black area). The handle allows the user to grasp the trowel along the length of the blade, providing a lengthwise grasp of the trowel for easy back and forth movement along the longitudinal direction.

FIG. 2 is a view of the contact surface of the blade. The contact surface comprises a flat, planar portion for leveling the cementitious material into its finished surface and a convex portion preferably located along the longitudinal edge of the contact surface. The planar surface is continuous with the edge of the convex portion, resulting in a smooth seamless finished surface on the cementitious material. The shorter edges of the blade, constituting the forward and rearward edges, have an edge design commonly found for finishing trowels along the planar section, while the edge along the convex portion has a plowing edge shaped in a cap to enable the user to easily work the excess cementitious material into the surface. Other embodiments include a shape similar to a flat bottom boat, a v-shaped, round-bottom boat or any other design such as, but not limited to, straight bow, a conventional clipper bow, a low-chin spoon bow, and a high-chin spoon bow to displace a viscous mixture and provide ease of use when working the cementitious material. As shown in front face of the trowel represented in FIG. 3, the preferred design is a smooth, round cap (black). The handle (textured) is fixed to the upper surface of the blade (white).

The blade can be made from any material or composition commonly used for making similar tools. Stainless steel or fiberglass are preferred embodiments. Both materials can be easily molded into the desired contact surface, easily cleaned after use, and can be cut for manufacturing trowels in large numbers.

Figure 4A:
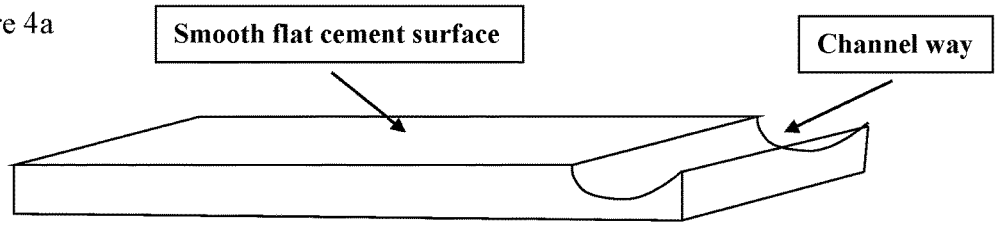
FIG. 4 is an example of the finished cementitious surface after being worked by the trowel of the present invention during the semi-cured state.
Figure 4B:
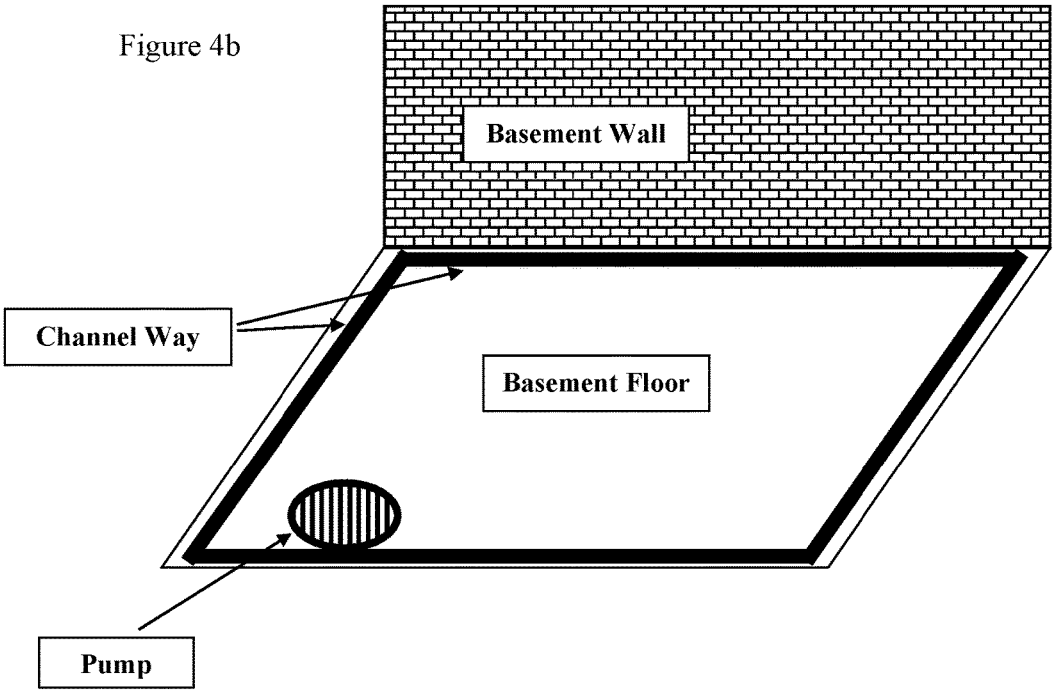

FIG. 4*a* and FIG. 4*b* are representative drawings of a finished surface after being worked by a trowel from the present invention. FIG. 4*a* shows a smooth flat cementitious surface, finished with the planar portion of the blade, while the channel is formed using the convex portion of the blade. The seamless interface between the convex portion and the planar portion of the blade results in a smooth edge defining the contact region of the channel way with the flat portion of the finished surface.

This trowel is useful for molding cementitious material where there is any need to easily form a channeled passage way within a smooth surface prior to the material curing or becoming hard. Accordingly, the trowel is ideal for viscous mixtures that eventually cure or polymerize with time such as cement or stucco.

In many new construction and even with older homes, builders finish the basement by installing a finished, smooth cement floor. FIG. 4*b* depicts a finished basement floor having a channel way formed along the perimeter of the cement floor. This cement flooring prevents the buildup of radon gas which enters the home through the ground and surrounding foundation. A continuous cement floor seals off the gas and allows homeowners to more safely use the rooms within the home, including the basement without excessive exposure to radon gas. During installation of the cement floor in the basement of these dwellings, the trowel of the present invention is useful in providing a channel way along the wall on the floor surface and within the finished basement floor. This channel way prevents water seeping through the basement walls from splaying across the floor. The channel way collects the water along the edge of the floor, allowing the water to evaporate within the confines of the channel way or be directed along the channel way to a pumping means, thus eliminating the water from randomly spreading across the finished basement floor.

Figure 5:
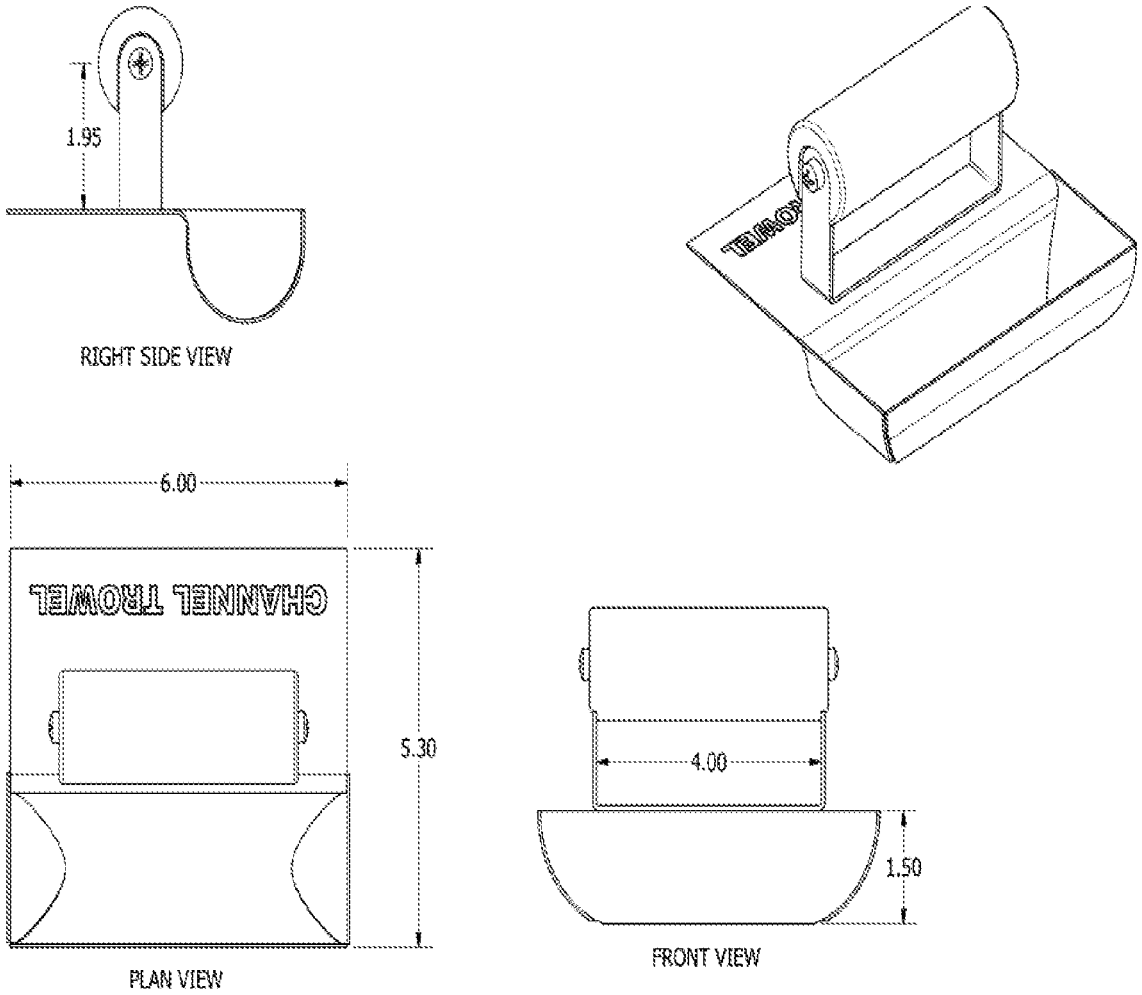
FIG. 5 depicts one embodiment of the present invention.

FIG. 5 depicts one embodiment of the present invention having a hollow cylindrical handle affixed to the upper surface of the blade through a tang that is affixed to the handle only at the forward and rearward ends to allow a comfortable grip. The handle is approximately 4.00 inches in length and 1.95 inches above the upper surface of the blade. The blade is 6.00 inches in length and 5.30 inches in width. The contact surface of the blade consists of a planar portion and an outward curved portion along the longitudinal edge wherein the outward curved portion incurvates a fluent cementitious surface. The outward curved portion has a depth of approximately 1.50 inches from the planar portion which is capped at the forward and rearward ends.

Although illustrated and described above with reference to certain specific embodiments, the present invention nevertheless is not intended to be limited to the details shown. Rather, various modifications may be made in the details within the scope and range of equivalents of the claims and without departing from the spirit of the invention.

We claim:

1. A trowel for use to form a contiguous channel in a cementitious material comprising:

a. a blade comprising a planar upper surface and a contact surface opposite the upper surface;

b. a handle attached to the upper surface;

wherein the contact surface comprises a planar surface, an outward curved surface, and at least one plowing surface; wherein the outward curved surface and the at least one plowing surface project from the planar surface in a direction opposite the upper surface, wherein the planar surface and the outward curved surface continuously extend along a longitudinal edge of the blade and the outward curved surface is closed on at least one longitudinal end with the at least one plowing surface that is inclined relative to the planar surface wherein a combined longitudinal length of the outward curved surface and the at least one plowing surface does not exceed an overall longitudinal length of the planar surface, wherein when used on the cementitious material the trowel is configured to be moved in a direction parallel to the longitudinal edge and the contact surface displaces the cementitious material to concurrently form both a flat surface with the planar surface and an incurvate channel surface with the outward curved surface and the at least one plowing surface in the cementitious material.

2. The trowel of claim 1 in which the handle is a hollow cylinder affixed to the upper surface of the blade to allow a comfortable grip.

3. The trowel of claim 1 further having tang projecting orthogonally from the upper surface of the blade to affix the handle parallel to the longitudinal edge of the blade.

4. The trowel of claim 3 where the tang is affixed only to the forward and rearward portions of the handle to allow a comfortable grip.

5. The trowel of claim 1 wherein the blade is composed of stainless steel.

6. The trowel of claim 1 wherein the blade is composed of fiberglass.

7. The trowel of claim 1 in which the at least one plowing surface is at least partially shaped by a cap.

8. The trowel of claim 1 in which the shape of the at least one plowing surface is selected from the group consisting of a straight bow, a conventional clipper bow, a low-chin spoon bow, and a high-chin spoon bow.

9. The trowel of claim 8 in which the at least one plowing surface is at least partially shaped by a cap.

10. The trowel of claim 1 in which the outward curved surface is closed on one longitudinal end, of the at least one longitudinal end, with one plowing surface, of the at least one plowing surface, that is inclined relative to the planar surface wherein a combined longitudinal length of the outward curved surface and the one plowing surface does not exceed the overall longitudinal length of the planar surface.

11. The trowel of claim 1 in which the outward curved surface is closed on two longitudinal ends, of the at least one longitudinal end, with two plowing surfaces, of the at least one plowing surface, that are inclined relative to the planar surface wherein a combined longitudinal length of the outward curved surface and the two plowing surfaces do not exceed the overall longitudinal length of the planar surface.

12. The trowel of claim 1 wherein the cementitious material is stucco, concrete or similar fluent material.

13. A trowel for use to form a contiguous channel in a cementitious material comprising:

a. a blade with an overall longitudinal length of approximately 6.00 inches and an overall width of approximately 5.30 inches comprising a planar upper surface and a contact surface opposite the upper surface;

b. a handle attached to the upper surface having a hollow cylinder approximately 4.00 inches long to allow a comfortable grip;

wherein the contact surface comprises a planar surface, an outward curved surface, and at least one plowing surface; wherein the outward curved surface and the at least one plowing surface project from the planar surface approximately 1.50 inches in a direction opposite the upper surface, wherein the planar surface and the outward curved surface continuously extend along a longitudinal edge of the blade and the outward curved surface is closed on at least one longitudinal end with the at least one plowing surface that is inclined relative to the planar wherein a combined longitudinal length of the outward curved surface and the at least one plowing surface does not exceed the overall longitudinal length of the planar surface, wherein when used on the cementitious material the trowel is configured to be moved in a direction parallel to the longitudinal edge and the contact surface displaces the cementitious material to concurrently form both a flat surface with the planar surface and an incurvate channel surface with the outward curved surface and the at least one plowing surface in the cementitious material.

14. The trowel of claim 13 in which the outward curved surface is closed on one longitudinal end, of the at least one longitudinal end, with one plowing surface, of the at least one plowing surface, that is inclined relative to the planar surface wherein a combined longitudinal length of the outward curved surface and the one plowing surface does not exceed the overall longitudinal length of the planar surface.

15. The trowel of claim 13 in which the outward curved surface is closed on two longitudinal ends, of the at least one longitudinal end, with two plowing surfaces, of the at least one plowing surface, that are inclined relative to the planar surface wherein a combined longitudinal length of the outward curved surface and the two plowing surfaces do not exceed the overall longitudinal length of the planar surface.

16. A trowel for use to form a contiguous channel in a cementitious material comprising:

a. a blade comprising a planar upper surface and a contact surface opposite the upper surface;

b. a handle is cylindrical and attached to the upper surface;

wherein the contact surface comprises a planar surface, an outward curved surface, and two plowing surfaces; wherein the outward curved surface and the plowing surfaces project from the planar surface in a direction opposite the upper surface, wherein the planar surface and the outward curved surface continuously extend along a longitudinal edge of the blade and the outward curved surface is closed on both longitudinal ends with the two plowing surfaces that are inclined relative to the planar surface wherein a combined longitudinal length of the outward curved surface and the two plowing surfaces do not exceed an overall longitudinal length of the planar surface, wherein when used on the cementitious material the trowel is configured to be moved in a direction parallel to the longitudinal edge and the contact surface displaces the cementitious material to concurrently form both a flat surface with the planar surface and an incurvate channel surface with the outward curved surface and at least one of the two plowing surfaces in the cementitious material.

17. The trowel of claim 16 in which the shape of the plowing surfaces are selected from the group consisting of a straight bow, a conventional clipper bow, a low-chin spoon bow, and a high-chin spoon bow.

18. The trowel of claim 17 in which the plowing surfaces are at least partially shaped by a cap.

* * * * *